US011090950B2

(12) United States Patent
Yorimoto et al.

(10) Patent No.: US 11,090,950 B2
(45) Date of Patent: Aug. 17, 2021

(54) HEATING ROLLER UNIT, DRYING DEVICE, AND PRINTER

(71) Applicants: Mamoru Yorimoto, Kanagawa (JP); Ken Onodera, Kanagawa (JP)

(72) Inventors: Mamoru Yorimoto, Kanagawa (JP); Ken Onodera, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/782,771

(22) Filed: Feb. 5, 2020

(65) Prior Publication Data

US 2020/0307259 A1 Oct. 1, 2020

(30) Foreign Application Priority Data

Mar. 26, 2019 (JP) ..... JP2019-058749

(51) Int. Cl.
*B41J 11/00* (2006.01)

(52) U.S. Cl.
CPC ..... *B41J 11/002* (2013.01)

(58) Field of Classification Search
CPC ..... B41J 11/002; F26B 13/183; F26B 13/18
See application file for complete search history.

(56) References Cited

U.S. PATENT DOCUMENTS

| | | | | |
|---|---|---|---|---|
| 4,825,560 | A * | 5/1989 | Nakamura | D06F 58/26 34/139 |
| 8,712,279 | B2 * | 4/2014 | Ueno | B65H 1/266 399/94 |
| 9,352,588 | B1 | 5/2016 | Boland et al. | |
| 9,908,342 | B1 | 3/2018 | Boland et al. | |
| 2014/0232797 | A1 | 8/2014 | Onodera et al. | |
| 2016/0313059 | A1 | 10/2016 | Boland et al. | |
| 2017/0120625 | A1 | 5/2017 | Yoshinuma | |
| 2017/0157951 | A1 | 6/2017 | Onodera | |
| 2017/0266990 | A1 | 9/2017 | Yoshinuma et al. | |
| 2017/0266991 | A1 | 9/2017 | Onodera et al. | |
| 2017/0334217 | A1 | 11/2017 | Yoshinuma et al. | |
| 2018/0009237 | A1 | 1/2018 | Sakamoto et al. | |
| 2018/0264803 | A1 | 9/2018 | Hoshino et al. | |
| 2018/0264849 | A1 | 9/2018 | Kitaoka et al. | |
| 2019/0291428 | A1 * | 9/2019 | Yamamoto | B41J 11/002 |

FOREIGN PATENT DOCUMENTS

| | | | |
|---|---|---|---|
| CN | 204095280 U | * | 1/2015 |
| JP | 2018-066552 | | 4/2018 |

* cited by examiner

*Primary Examiner* — Sharon Polk
(74) *Attorney, Agent, or Firm* — Duft & Bornsen, PC

(57) ABSTRACT

A heating roller unit includes a heating roller, a heat source disposed inside the heating roller, and a tubular member at an end of the heating roller. Inside the tubular member, a terminal of the heat source is disposed. The tubular member has an opening via which inside of the tubular member communicates with an outside in a direction intersecting with an axial direction of the heating roller.

8 Claims, 19 Drawing Sheets

HEATING ROLLER UNIT, DRYING DEVICE, AND PRINTER

CROSS-REFERENCE TO RELATED APPLICATION

This patent application is based on and claims priority pursuant to 35 U.S.C. § 119(a) to Japanese Patent Application No. 2019-058749, filed on Mar. 26, 2019, in the Japan Patent Office, the entire disclosure of which is hereby incorporated by reference herein.

BACKGROUND

Technical Field

The present disclosure relates to a heating roller unit, a drying device, and a printer.

Related Art

As a printer to apply a liquid to a printing target such as roll paper, a continuous form sheet, and a ribbon-like continuous medium (a web), there is an apparatus including a drying device to promote drying of the applied liquid.

Conventionally, for example, there are drying devices that include a plurality of heating rollers that contact continuous paper and a heating drum having a larger diameter than the heating rollers.

SUMMARY

According to an embodiment of this disclosure, a heating roller unit includes a heating roller, a heat source disposed inside the heating roller, and a tubular member at an end of the heating roller. Inside the tubular member, a terminal of the heat source is disposed. The tubular member has an opening. Via the opening, an inside of the tubular member communicates with an outside in a direction intersecting with an axial direction of the heating roller.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
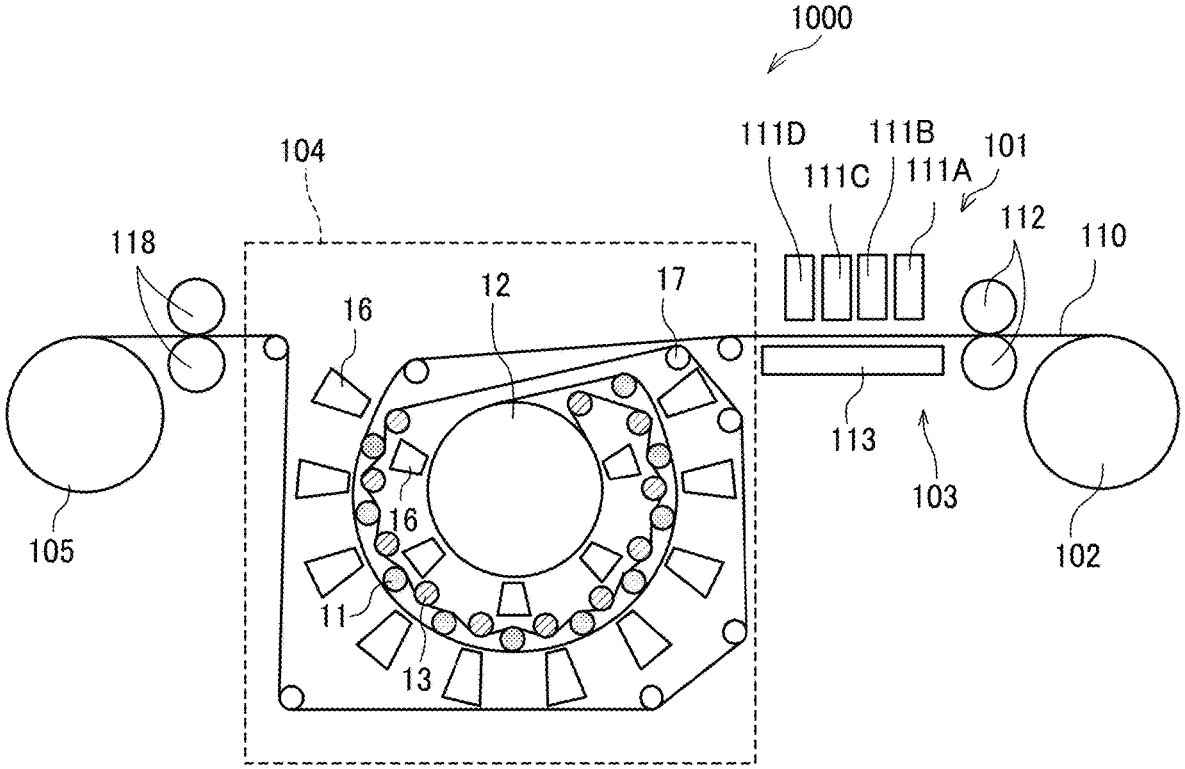
FIG. 1 is a schematic cross-sectional view illustrating an example of a printer according one embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a", "an", and "the" are intended to include the plural forms as well, unless the context clearly indicates otherwise.

A printer according to one embodiment of the present disclosure is described with reference to FIG. 1. FIG. 1 is a schematic cross-sectional view illustrating a printer 1000 according to one embodiment.

The printer 1000 is an inkjet recording apparatus and includes a liquid application unit 101 that includes liquid discharge heads as liquid application devices. The liquid discharge heads discharge and apply an ink (a liquid) of a designated color to a continuous sheet 110 to be dried.

The liquid application unit 101 includes, for example, from the upstream side in the direction in which the continuous sheet 110 is conveyed (sheet conveyance direction), full-line heads 111 (111A, 111B, 111C, and 111D) for four colors. The heads 111A, 111B, 111C, and 111D apply liquids of black (K), cyan (C), magenta (M), and yellow (Y) to the continuous sheet 110, respectively. The colors and the number of colors are not limited thereto.

The continuous sheet 110 is fed out from a feeding roller 102, and a pair of the conveyance rollers 112 of a conveyance unit 103 conveys the continuous sheet 100 onto a sheet conveyance guide 113 disposed opposite the liquid application unit 101. The continuous sheet 110 is then conveyed (moved), guided by the sheet conveyance guide 113.

The continuous sheet 110 to which the liquid has been applied by the liquid application unit 101 passes through a drying device 104 according to one embodiment of the present embodiment. A pair of sheet ejection rollers 118 further conveys the continuous sheet 110, and a winding roller 105 winds the continuous sheet 110.

Note that, although the printer using a continuous object such as continuous paper is described, aspects of the present disclosure can adapt to drying devices of printers that use sheet materials such as cut sheets.

Figure 2:
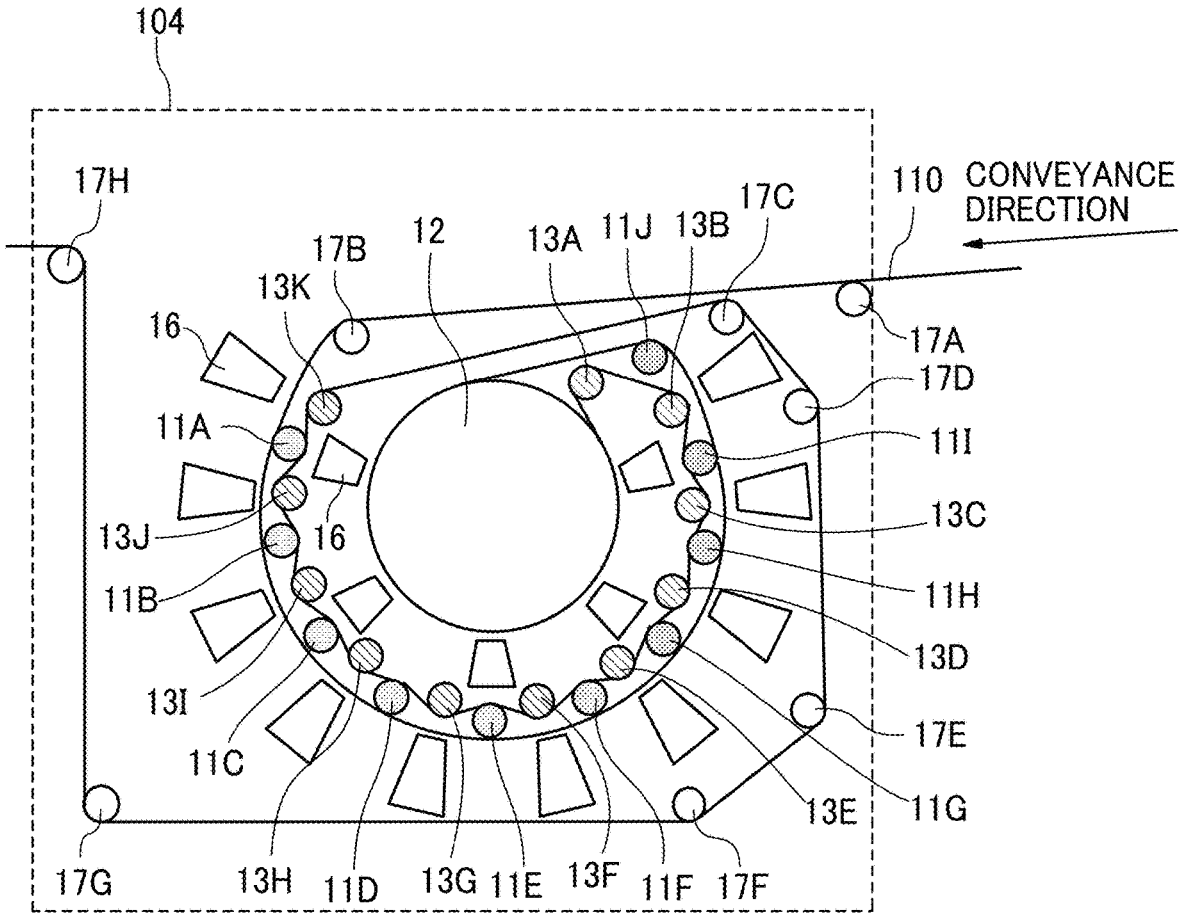
FIG. 2 is an enlarged view of a drying device of the printer, according to one embodiment of the present disclosure.

Next, the drying device 104 of the printer 1000 is described with reference also to FIG. 2. FIG. 2 is an enlarged view illustrating the drying device.

The drying device 104 includes a plurality of heating rollers 11 (11A to 11J), as a plurality of contact heaters each having a curved contact face to contact and heat the continuous sheet 110. The drying device 104 further includes a heating drum 12, as another contact heater having a curved contact face.

The drying device 104 further includes a plurality of guide rollers 13 (13A to 13K). The guide roller 13A is disposed downstream from the heating drum 12 in the sheet conveyance direction and functions as a contact guide to guide the continuous sheet 110 to the heating roller 11J. The guide rollers 13B to 13K function as contact guides to guide the continuous sheet 110, which has been guided by the guide roller 13A, to contact the heating rollers 11I to 11A.

That is, in the present embodiment, as described above, the continuous sheet 110 to be dried contacts the heating rollers 11A to 11I from different directions, and is heated.

The plurality of heating rollers 11A to 11J is in a substantially arc-shaped arrangement around the heating drum 12. Each of the heating rollers 11 and holder plate supporting the heating roller 11 are united into a heating roller unit 301 described later. Note that the diameters of the heating rollers 11A to 11J can be identical to or different from each other. Further, each of the guide rollers 13B to 13K is disposed between adjacent heating rollers 11.

The plurality of heating rollers 11 (i.e., the heating rollers 11A to 11J), the heating drum 12, and the plurality of guide rollers 13 (i.e., the guide rollers 13A to 13K) define a conveyance passage along which the continuous sheet 110 is heated (a heating conveyance passage). The continuous sheet 110 is conveyed while contacting the outer circumference of the plurality of heating rollers 11 in the substantially arc-shaped arrangement, upstream from the heating drum 12 in the sheet conveyance direction. After passing the heating drum 12, the continuous sheet 110 is conveyed while being guided by the guide rollers 13 to contact the inner circumference of the plurality of heating rollers 11. The terms "outer circumference" and "inner circumference" here represent the outer side and the inner side in the radial direction around the heating drum 12, respectively.

Further, the drying device 104 includes a plurality of air blowers 16 disposed outward of the arrangement of the plurality of heating rollers 11 in the radial direction. The air blowers 16 are contactless heaters and heat the continuous sheet 110 from the liquid applied side of the continuous sheet 110. A plurality of air blowers 16 is also disposed around the heating drum 12.

The drying device 104 further includes guide rollers 17A and 17B to guide entry of the continuous sheet 110 into the drying device 104, and a plurality of guide rollers 17C to 17H (collectively "guide rollers 17") to guide exit of the continuous sheet 110 from the drying device 104 after passing by the guide roller 13K.

With the above-described configuration, the drying device 104 performs drying as follows. While the heating rollers 11 contact and heat the back face of the continuous sheet 110 opposite the liquid applied side thereof, the air blowers 16 blow air toward the liquid applied side of the continuous sheet 110 to heat the liquid applied side.

Next, the continuous sheet 110 is heated while being conveyed with the face opposite the liquid applied side of the continuous sheet 110 in contact with the outer circumference of the heating drum 12 inside the plurality of heating rollers 11. At the same time, the air blowers 16 blow air to the liquid applied side of the continuous sheet 110 to heat the liquid applied side.

Thereafter, while the guide rollers 13 contact the liquid applied side of the continuous sheet 110, the heating rollers 11 contact the opposite face of the continuous sheet 110 and heat the continuous sheet 110, thereby drying the liquid applied to the continuous sheet 110.

Figure 3:
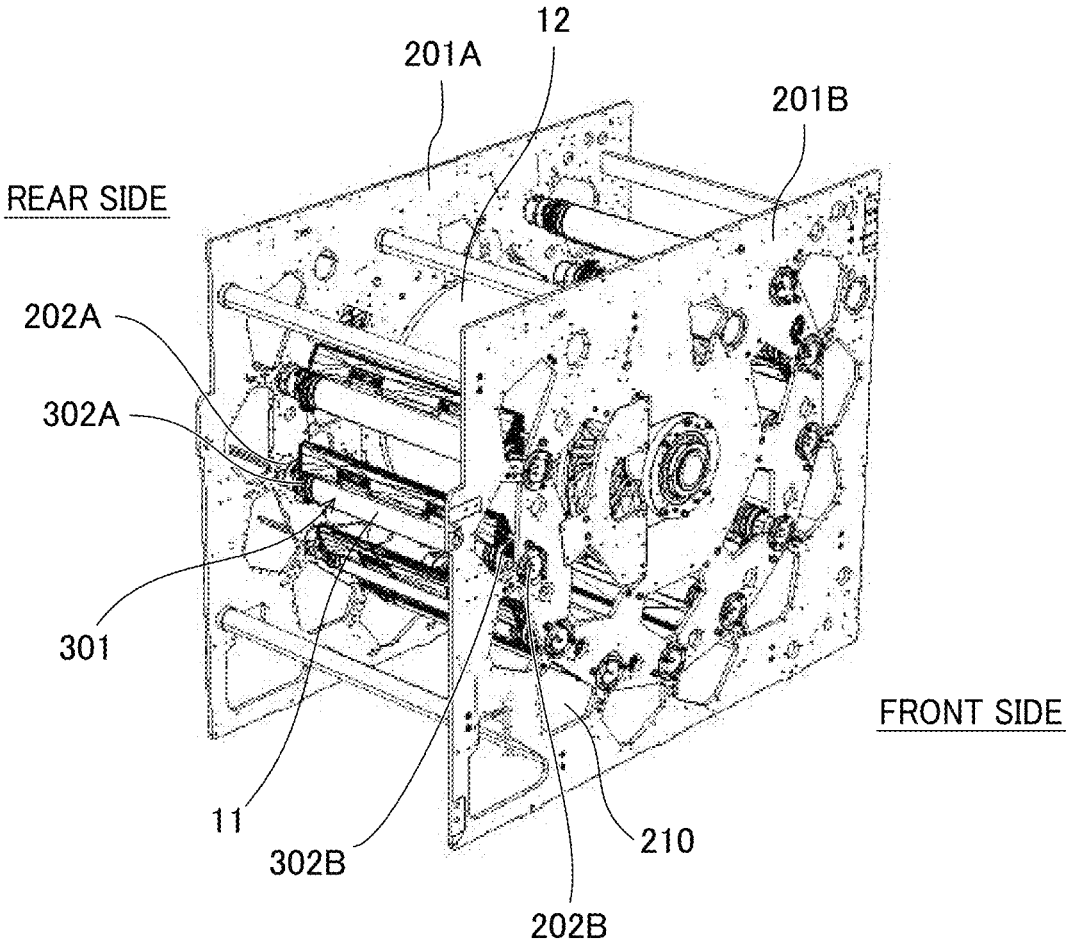
FIG. 3 is a perspective view of a pair of side plates to which a heating roller unit of the drying device illustrated in FIG. 2 is attached.
Figure 4:
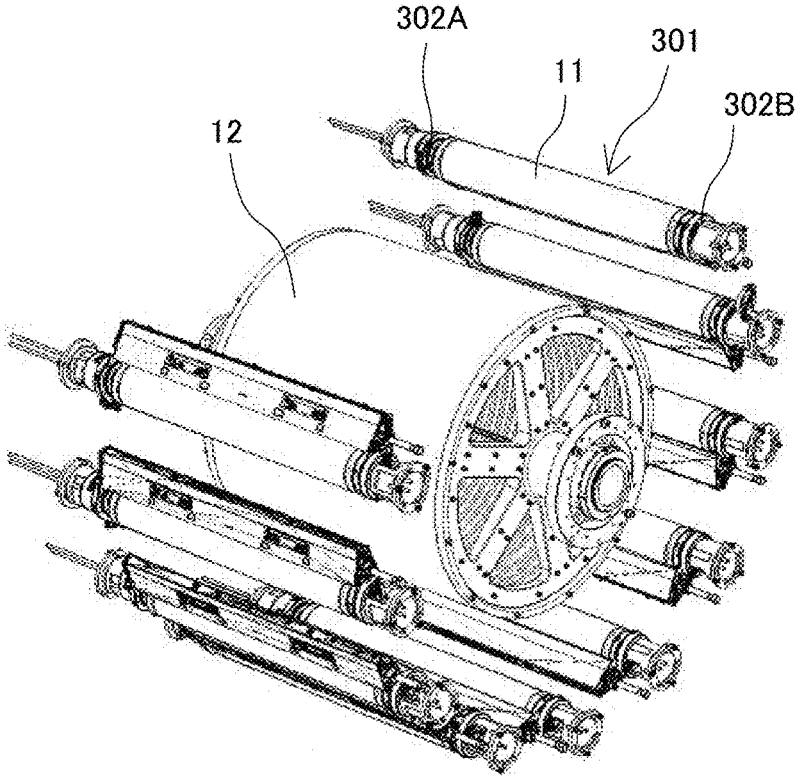
FIG. 4 is a perspective view of a heating drum and the heating roller unit of the drying device.
Figure 5:
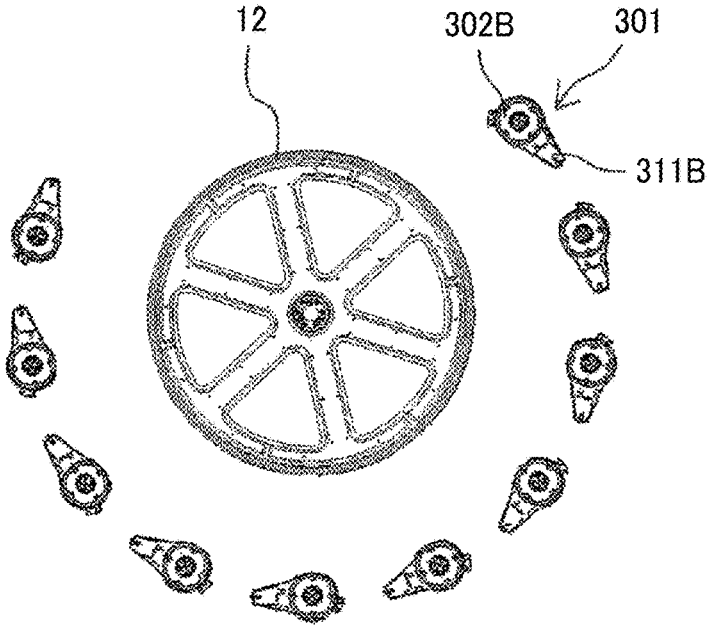
FIG. 5 is a front view illustrating an arrangement of the heating roller unit and the heating drum.
Figure 6:
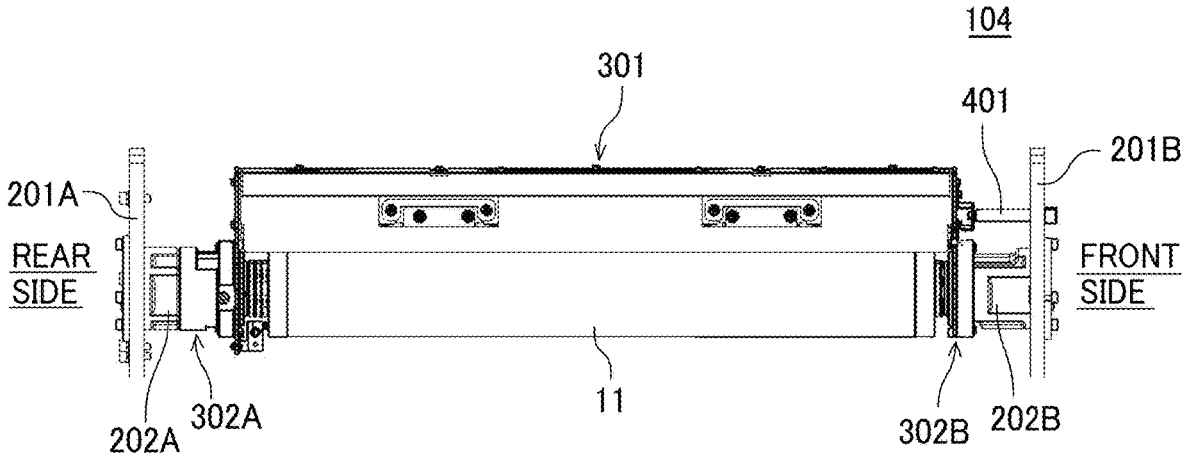
FIG. 6 is a side view illustrating relative positions between the side plates and the heating roller unit.

Next, the placement of the heating roller unit of the drying device is schematically described with reference to FIGS. 3 to 6. FIG. 3 is a perspective view of a pair of side plates to which the heating roller unit is attached. FIG. 4 is a perspective view illustrating the heating drum and the heating roller unit. FIG. 5 is a front view illustrating the arrangement of the heating roller unit and the heating drum. FIG. 6 is a side view illustrating the relative positions between both side plates and the heating roller unit.

The heating roller unit 301 including the heating roller 11 described above is held between two side plates 201 (201A and 201B) of the drying device 104, disposed opposite to each other. The side plates 201 serve as a frame. In the present embodiment, the drying device 104 is installed so that the side plate 201A serves as a rear side plate, and the side plate 201B serves as a front side plate.

A first end portion 302A of the heating roller unit 301 is held with a first tubular holder 202A on the side plate 201A, one of the two side plates 201. A second end portion 302B is held with a second tubular holder 202B on the other side plate 201B.

In this state, as illustrated in FIG. 5, the heating roller units 301 arranged around the heating drum 12 are held between the two side plates 201 in different postures depending on the arrangement positions in the arc-shaped direction.

In addition, the side plates 201A and 201B include insertion ports 210 into which the air blowers 16 are inserted.

Figure 7:
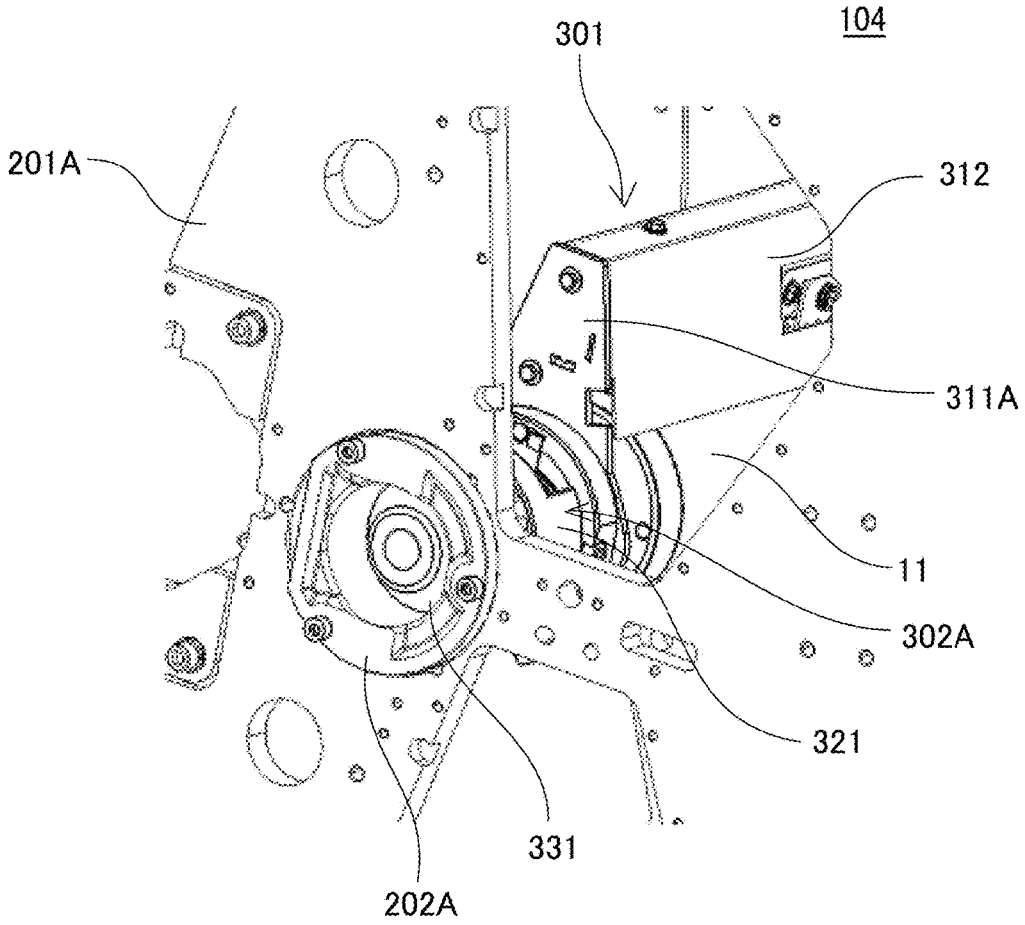
FIG. 7 is a perspective view of a main part of the drying device in a state where a first end portion of the heating roller unit is held on the side plate.
Figure 8:
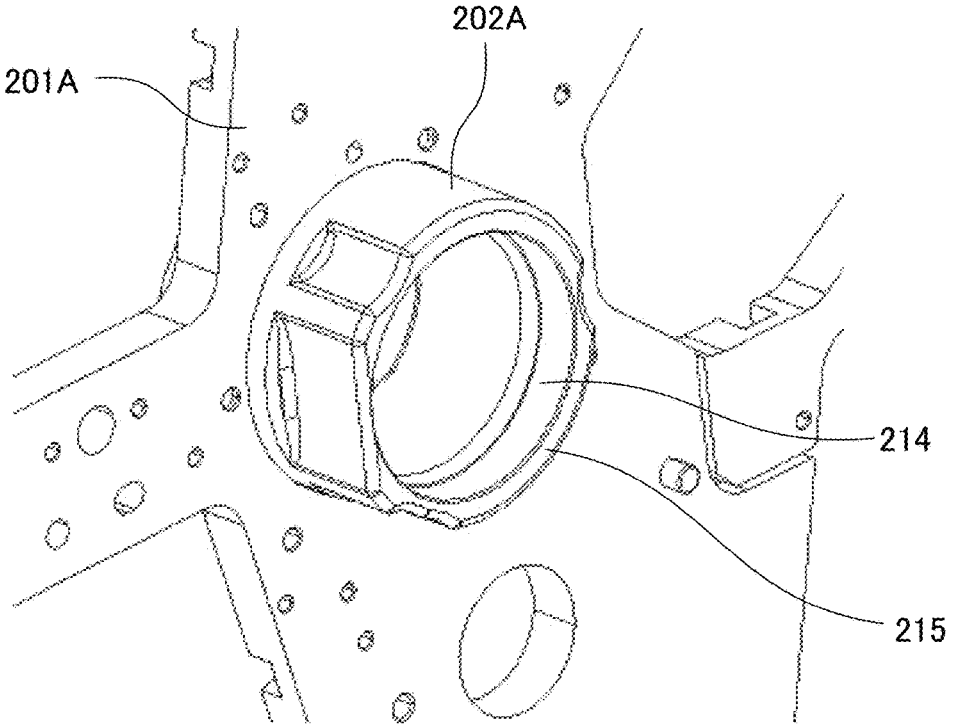
FIG. 8 is a perspective view of a first tubular holder on the side plate.
Figure 9:
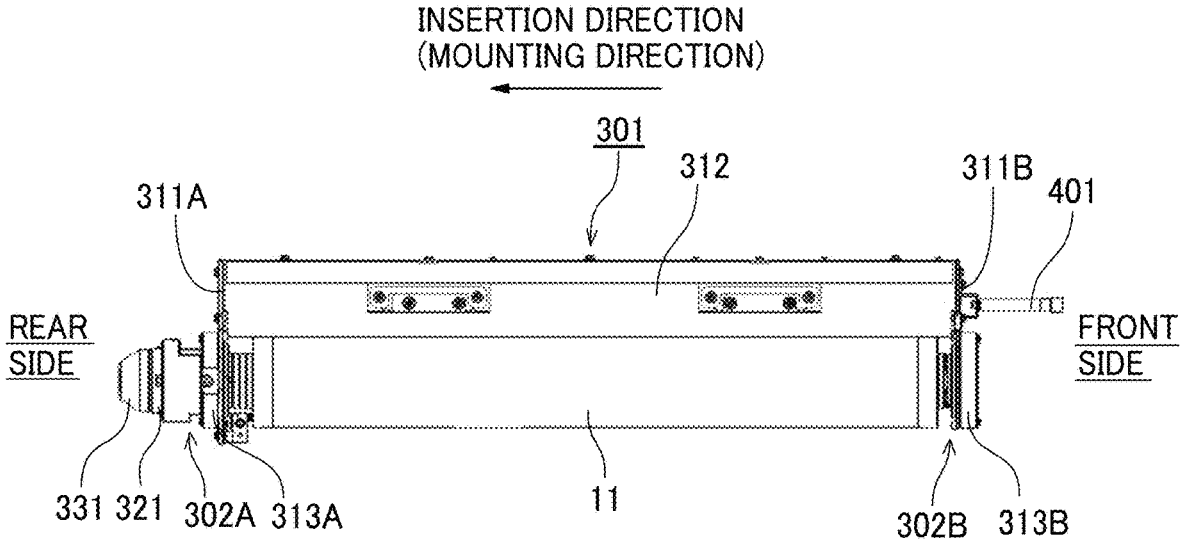
FIG. 9 is a front view of the heating roller unit.
Figure 10:
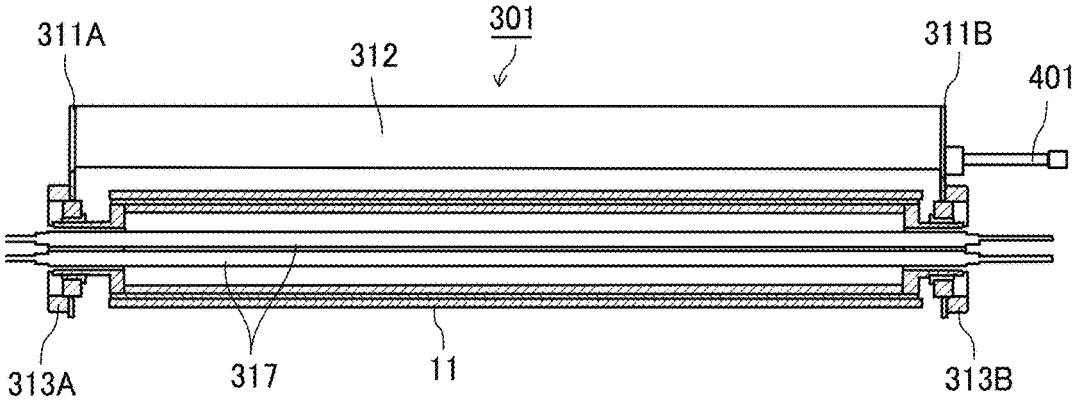
FIG. 10 is a cross-sectional view of the heating roller unit as viewed from the front side.
Figure 11:
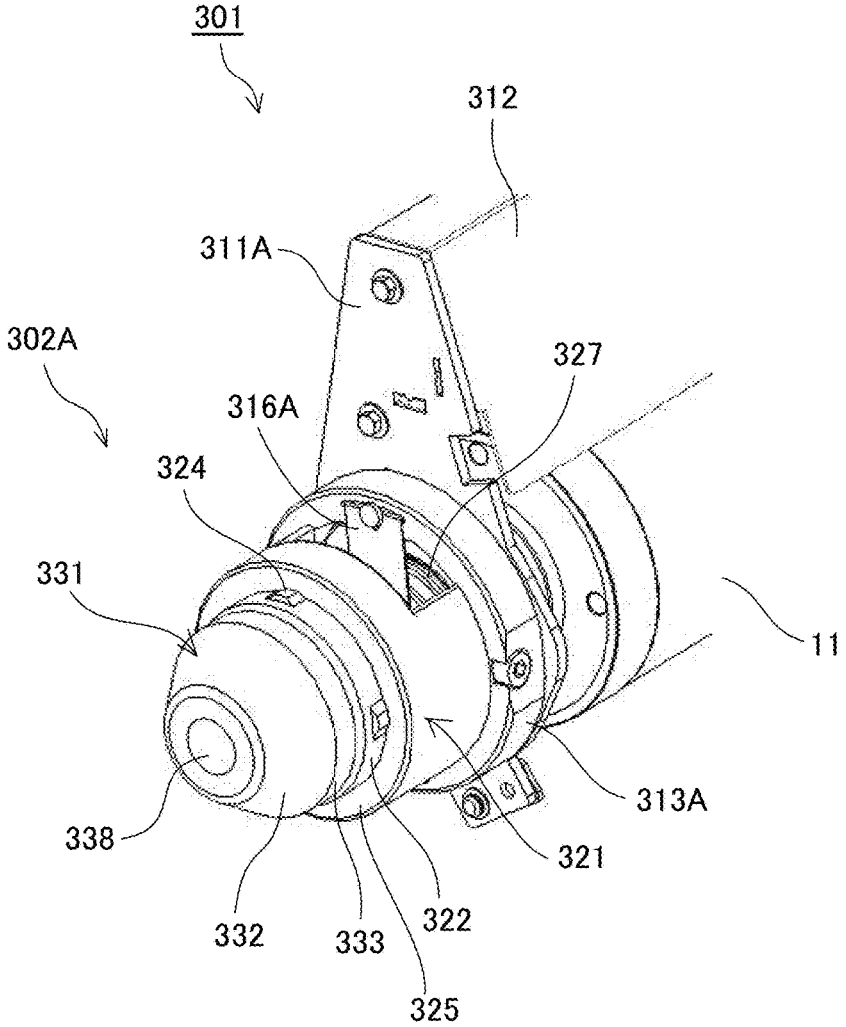
FIG. 11 is a perspective view of the first end portion of the heating roller unit.
Figure 12:
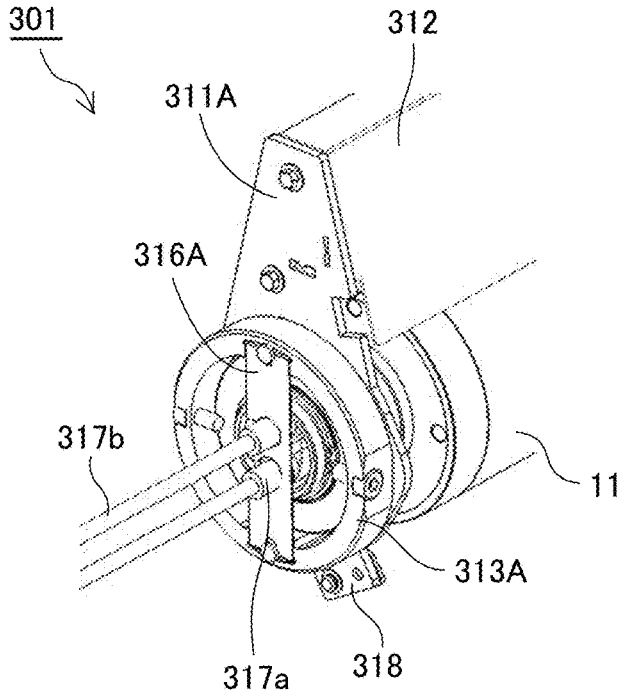
FIG. 12 is a perspective view illustrating an interior of the first end portion of the heating roller unit illustrated in FIG. 11.
Figure 13:
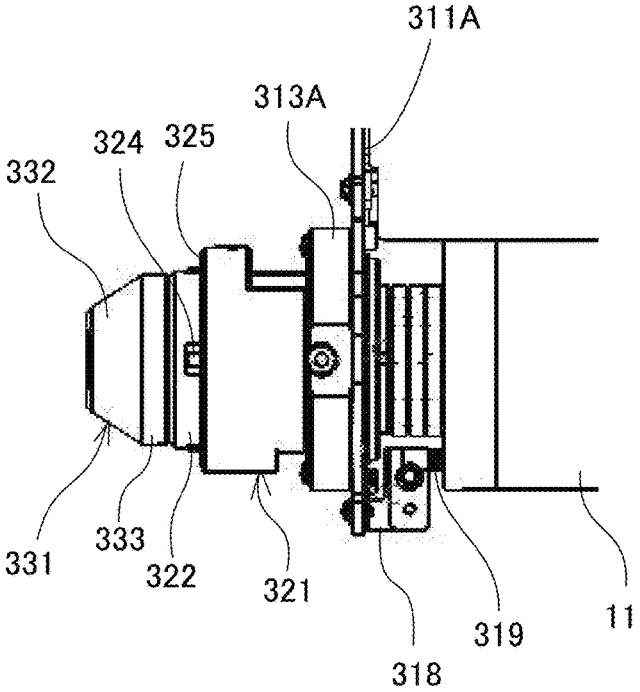
FIG. 13 is an enlarged view of a main part of the first end portion of the heating roller unit.
Figure 14:
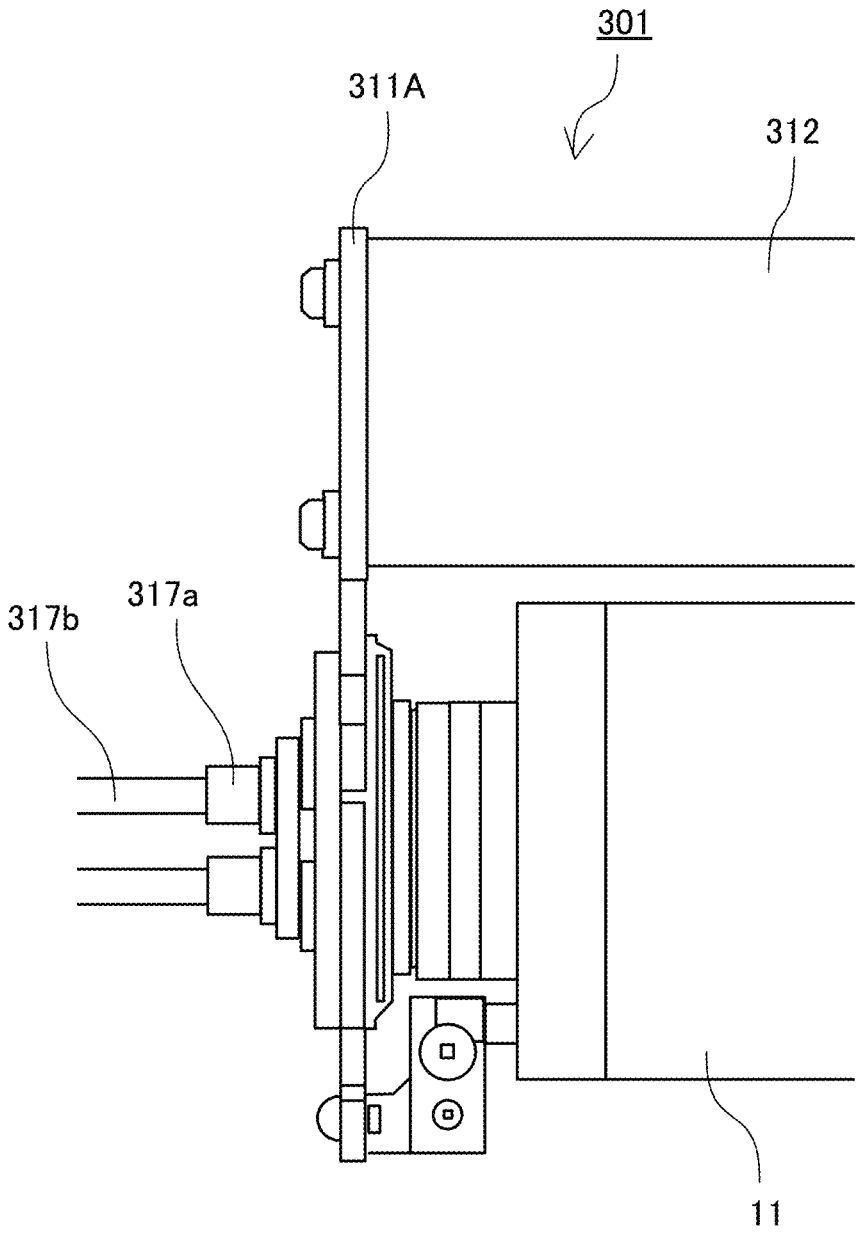
FIG. 14 is an enlarged view of the main part of the first end portion of the heating roller unit with a tubular member removed.
Figure 15:
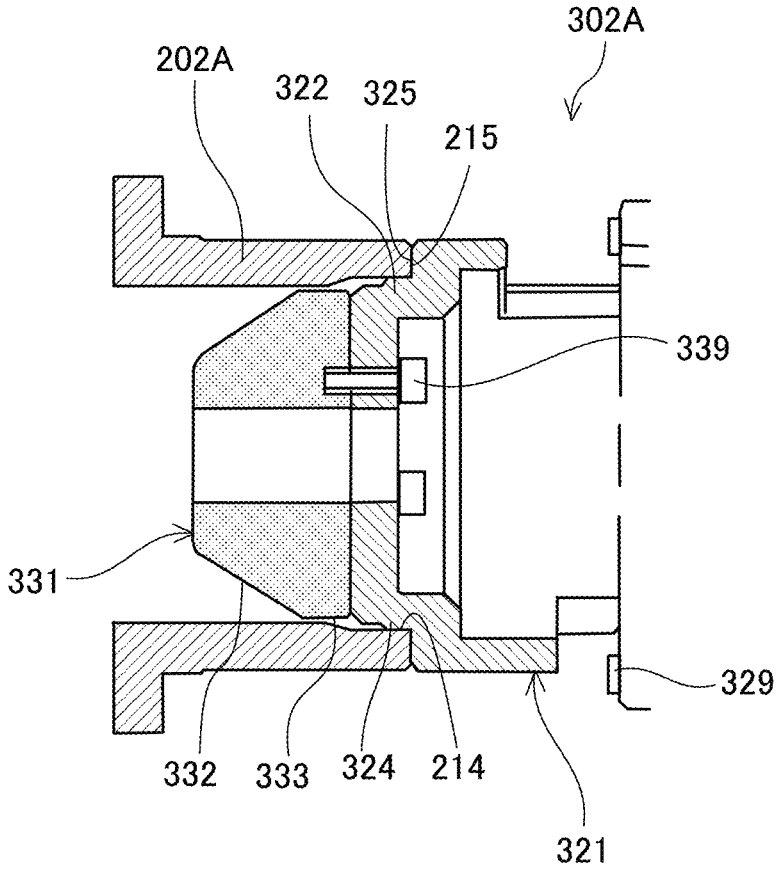
FIG. 15 is a cross-sectional view illustrating a state where the first end portion of the heating roller unit and the first tubular holder of the side plate are fitted together.

Next, a structure to hold the first end portion of the heating roller unit on the side plate is described with reference to FIGS. 7 to 15. FIG. 7 is a perspective view of a main part of the drying device 104 a state where the first end portion of the heating roller unit is held on the side plate, and FIG. 8 is a perspective view of the first tubular holder of the side plate. FIG. 9 is a front view of the heating roller unit. FIG. 10 is a cross-sectional view of the heating roller unit as viewed from the front side. FIG. 11 is a perspective view of the first end portion of the heating roller unit. FIG. 12 is a perspective view illustrating an interior of the first end portion of the heating roller unit. FIG. 13 is an enlarged view of the main part of the first end portion of the heating roller unit. FIG. 14 is an enlarged view of the main part of the first end portion of the heating roller unit with a tubular member removed. FIG. 15 is a cross-sectional view illustrating a state where the first end portion of the heating roller unit is fitted with the first tubular holder of the side plate.

On the side plate 201A, the first tubular holder 202A that holds the first end portion 302A of the heating roller unit 301 is fixed.

The heating roller unit 301 includes the heating roller 11, side plates 311A and 311B (holder plates) provided with bearings 380 (see FIG. 16), and a stay 312 to couple the side plates 311A and 311B together. The bearings 380 that rotatably hold both ends of the heating roller 11, respectively, are attached.

The heating roller 11 is a hollow roller, inside which two heater lamps 317 as heat sources are disposed.

On the side plate 311A, a circular member 313A (see FIG. 9) is fixed. On the circular member 313A, a lamp holder 316A (serving as a heat source holder, see FIG. 11) is attached. The lamp holder 316A holds the ends of the two heater lamps 317 (see FIG. 10) disposed inside the heating roller 11. As illustrated in FIG. 12, each heater lamp 317 includes a terminal 317*a* at the end, and a cable 317*b* is connected to the terminal 317*a*.

As illustrated in FIG. 13, a discharge brush holder 318 holding a discharge brush 319 is attached to the circular member 313A.

Referring to FIGS. 7 and 9. the first end portion 302A of the heating roller unit 301 includes a fitting member 321 that fits in the first tubular holder 202A and a tapered member 331. The tapered member 331 is positioned outward of the fitting member 321 in the axial direction of the heating roller 11 (hereinafter "roller axial direction"), that is, further from the axial center of the heating roller 11 than the fitting member 321. The tapered member 331 enters the first tubular holder 202A.

The fitting member 321 is a tubular member and screwed to the circular member 313A with screws 329 (see FIG. 15). Thus, the terminals 317*a* (see FIG. 12) at the end of the heater lamps 317 are disposed inside the fitting member 321 which is the tubular member.

The fitting member 321 (the tubular member) includes an opening 327 (see FIG. 11), serving as an air vent, connecting the inside and the outside in a direction intersecting the axial direction. A portion of the lamp holder 316A that holds the ends of the heater lamps 317 protrude from the opening 327.

The lamp holder 316A is a metal plate. Of the lamp holder 316A, the portion protruding from the opening 327 of the fitting member 321 becomes cooler than the portion inside the fitting member 321. Thus, the protruding portion serves as a heat dissipating portion to release the heat from inside.

Referring to FIG. 15, the fitting member 321 is screwed to the circular member 313A with the screws 329. The fitting member 321 includes a fitting portion 322 provided with a plurality of projections 324. The projections 324 contact an inner peripheral face 214 of the first tubular holder 202A. Referring to FIG. 13, the fitting member 321 includes a contact portion 325 on the circular member 313A side of the fitting portion 322. The contact portion 325 is a stepped portion that contacts the axial end face 215 (see FIG. 8) of the first tubular holder 202A.

The projections 324 of the fitting portion 322 can facilitate fitting of the fitting portion 322 into the first tubular holder 202A and positioning of the fitting portion 322 in the direction orthogonal to the axis of the heating roller 11.

Additionally, with the contact portion 325 that is the stepped portion to contact the end face 215 of the first tubular holder 202A, the heating roller 11 can be accurately positioned in the roller axial direction.

The length of the projections 324 of the fitting portion 322 of the fitting member 321 is set such that the projections 324 fit with the inner peripheral face 214 (see FIGS. 8 and 15) of the first tubular holder 202A at the end of the insertion of the fitting member 321 into the first tubular holder 202A. Further, the projections 324 of the fitting portion 322 of the fitting member 321 are arranged at four locations in the circumferential direction so that the fitting portion 322 can smoothly fit in the inner peripheral face 214 of the first tubular holder 202A.

The tapered member 331 is fixed to the fitting member 321 with a screw 339 (see FIG. 15) or the like. The tapered member 331 includes a tapered portion 332 (see FIGS. 11 and 15) that enters the first tubular holder 202A. Due to the relative positions between the tapered member 331 and the fitting member 321, the tapered portion 332 is disposed outward of (closer to the end than) the fitting portion 322 in the roller axial direction and enters the first tubular holder 202A.

The tapered member 331 includes a cylindrical portion 333 that is continuous with the tapered portion 332 and on the fitting member 321 side of the tapered portion 332. The cylindrical portion 333 has such a diameter that the cylindrical portion 333 is contactless with the inner peripheral face 214 of the first tubular holder 202A in a state where the fitting portion 322 is fitted inside the inner peripheral face 214 of the first tubular holder 202A.

The lengths (axial lengths) and shapes of the tapered portion 332 and the cylindrical portion 333 of the tapered member 331 are set so that the tapered portion 332 can be inserted into the first tubular holder 202A even if the alignment therebetween is rough.

The cables 317*b* of the heater lamps 317 pass through the axial center portions of the fitting member 321 and the tapered member 331.

In a structure in which a terminal of a heat source is in the vicinity of an end of the heating roller containing the heat source, there is a following risk. When the heated air flows out from inside the heating roller through the end, the terminal of the heat source is heated and may be damaged.

Figure 16:
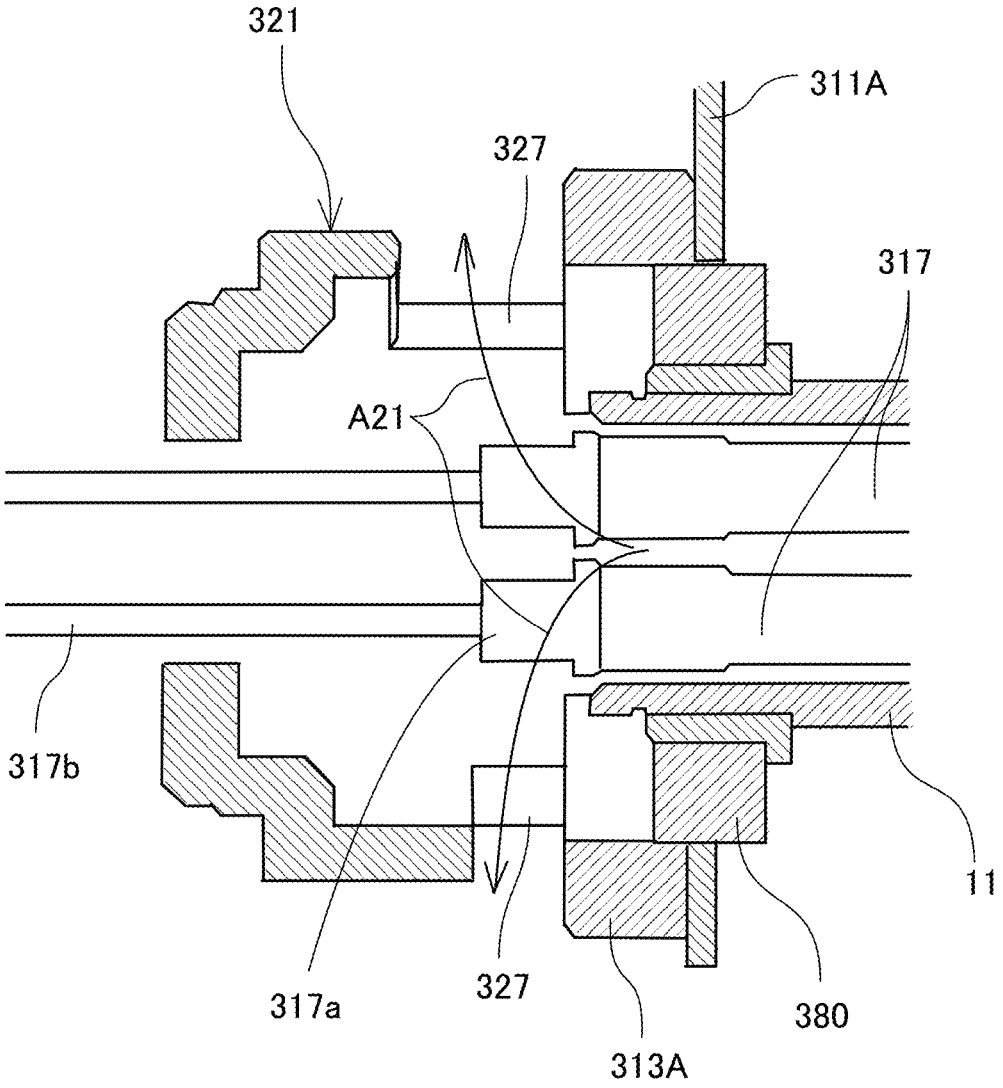
FIG. 16 is a cross-sectional view illustrating an air flow at an end of the heating roller unit.
Figure 17:
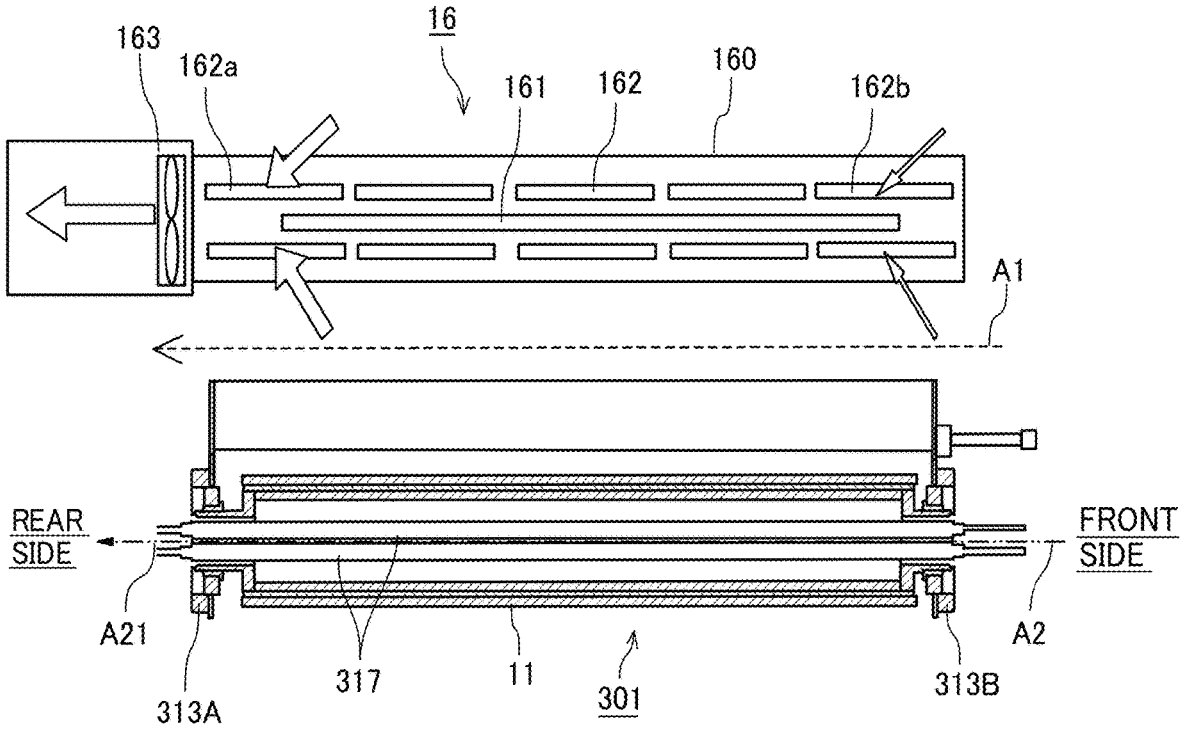
FIG. 17 is a view illustrating an air flow around the air blower and in the heating roller unit.

Next, an air flow in the heating roller unit is described with reference to FIGS. 16 and 17. FIG. 16 is a cross-sectional view illustrating the air flow at the end of the heating roller unit, and FIG. 17 is a view illustrating the air flow around the air blower and in the heating roller unit.

The air blower 16 has capabilities to blow air to a sheet material and suck ambient air to exhaust the sucked air outside the apparatus.

The air blower 16 has a passage member 160. The passage member 160 includes a blowout opening 161 for blowing out air and a plurality of air intakes 162 to introduce air, extending in the longitudinal direction (same as the axial direction of the heating roller 11). Referring to FIG. 17, one of the plurality of air intakes 162 on the rear side (FIG. 3) is referred to as an air intake 162*a*, and the one on the front side (FIG. 3) is referred to as an air intake 162*b*.

An air suction fan 163 is attached to an end of the passage member 160 on the rear side in FIG. 3, that is, the same as the fitting member 321 (the tubular member) of the heating roller unit 301 in the axial direction of the heating roller 11. The air suction fan 163 exerts a suction force on the air intakes 162 (generates a negative pressure at the air intakes 162).

When the air suction fan 163 of the air blower 16 is driven, the intake amount sucked from the air intake 162*a* on the rear side close to the air suction fan 163 is larger than the intake amount of air sucked from the air intake 162*b* on the front side.

Figure 20:
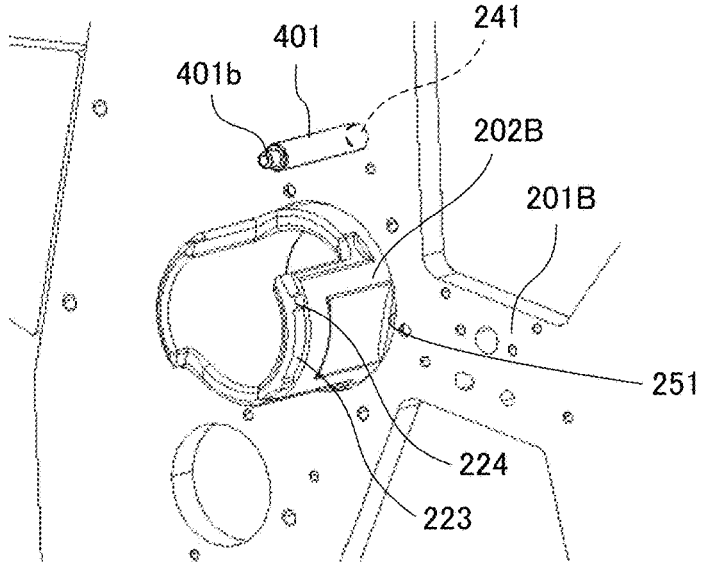
FIG. 20 is a perspective view of a second tubular holder of the side plate illustrated in FIG. 19.

Therefore, an air flow A1 heading from the front side to the rear side is generated around the air blower 16 and the heating roller unit 301 as indicated by arrows in FIG. 20.

Following the air flow A1, an air flow A2 heading from the front side to the rear side is also generated inside the heating roller 11 of the heating roller unit 301 as indicated by an arrow. The air flow A2 guides relatively cool air into the heating roller 11 from the front side, and air A21 heated by the heater lamps 317 flows out from the rear side.

At this time, since the fitting member 321 (the tubular member), in which the terminals 317*a* of the heater lamps 317 are disposed, includes the opening 327 (see FIG. 16) communicating the inside with the outside in the direction intersecting the axial direction, the heated air A21 flows out from the opening 327.

Accordingly, the air can be prevented from staying in the vicinity of the terminals 317*a* of the heater lamps 317, and damage to the terminals 317*a* of the heater lamps 317 can be prevented. Therefore, the distance between the end of the heater lamp 317 and the terminal 317*a* of the heater lamp 317 can be shortened, and the apparatus can be made compact.

Next, a description is given below of mounting of the heating roller unit 301 to the side plate 201A, as a part of the mounting procedure of the heating roller unit 301.

Referring to FIG. 3, when the heating roller unit 301 is held between the assembled side plates 201A and 201B, the insertion ports 210 on the side plate 201B for the air blowers 16 are open.

Then, an operator inserts the heating roller unit 301 obliquely from the insertion port 210 of the side plate 201B, and inserts the tapered member 331 of the first end portion 302A into the first tubular holder 202A. At this time, since the tapered portion 332 (see FIG. 15) is at the tip of the first end portion 302A, the first end portion 302A can be easily inserted into the first tubular holder 202A.

That is, even when the heating roller unit 301 is inserted obliquely with respect to the first tubular holder 202A, the tapered portion 332 hits the end face 215 of the first tubular holder 202A, and the first end portion 302A is guided into the first tubular holder 202A.

When the tapered member 331 of the first end portion 302A enters the first tubular holder 202A, the heating roller unit 301 is pushed in the insertion direction. Accordingly, the tapered portion 332 and the cylindrical portion 333 of the first end portion 302A enter the first tubular holder 202A in this order, and the fitting portion 322 is guided into the first tubular holder 202A.

Until the fitting portion 322 of the first end portion 302A is fitted in the first tubular holder 202A, the tapered portion 332 of the tapered member 331 also acts as an axis aligner to guide the axis of the heating roller 11 to be aligned with the axis of the first tubular holder 202A.

Then, the projections 324 on the fitting portion 322 contact the inner peripheral face 214 of the first tubular holder 202A, and the contact portion 325 hits the end face 215 of the first tubular holder 202A. Then, the first end portion 302A is held in the first tubular holder 202A.

When the heating roller unit 301 is inserted between the side plates 201A and 201B from an oblique direction to hold the first end portion 302A in the first tubular holder 202A as described above, the tapered portion 332 can be easily inserted into the first tubular holder 202A. Thus, workability of the mounting of the heating roller unit 301 can be improved.

In the present embodiment, the insertion port 210 for the air blower 16 also serves as an insertion port for (attaching) inserting the heating roller unit 301. This is because the number of openings is limited in order to maintain the rigidity of the side plate 201.

As a result, the position of the first tubular holder 202A is shifted from the position of the insertion port 210. Accordingly, the first end portion 302A of the heating roller unit 301 is inserted into the first tubular holder 202A from an oblique direction.

At this time, as described above, owing to the tapered portion 332, the first end portion 302A can be easily inserted into the first tubular holder 202A, and the fitting portion 322 of the first end portion 302A can be fitted in the first tubular holder 202A.

Figure 18:
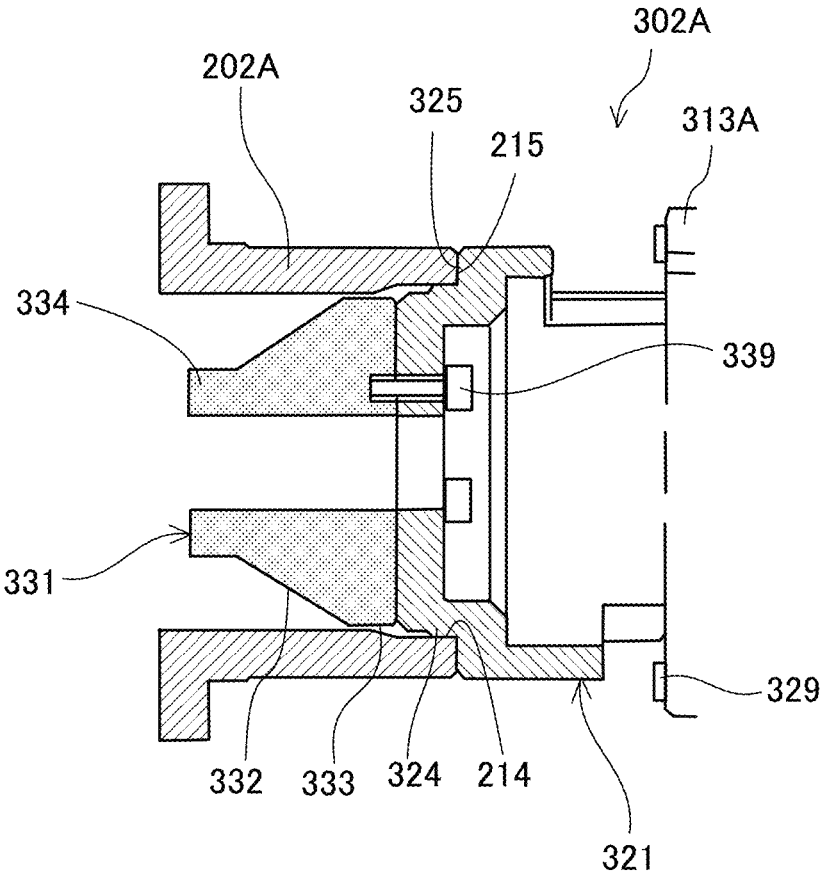
FIG. 18 is a cross-sectional view of another example of the first end portion of the heating roller unit, in a state fitted with the first tubular holder of a side plate.

Next, another example of the first end portion of the heating roller unit is described with reference to FIG. 18. FIG. 18 is a cross-sectional view of another example of the first end portion of the heating roller unit, in a state fitted with the first tubular holder of the side plate.

In the present embodiment, the tapered member 331 includes a cylindrical portion 334 disposed at the end of the tapered portion 332 and has the same diameter as the minimum diameter of the tapered portion 332.

Even in the configuration in which the tapered portion 332 itself is not the tip, the first end portion 302A can be inserted into the first tubular holder 202A similar to the first embodiment, and workability of assembly work is improved.

Figure 19:
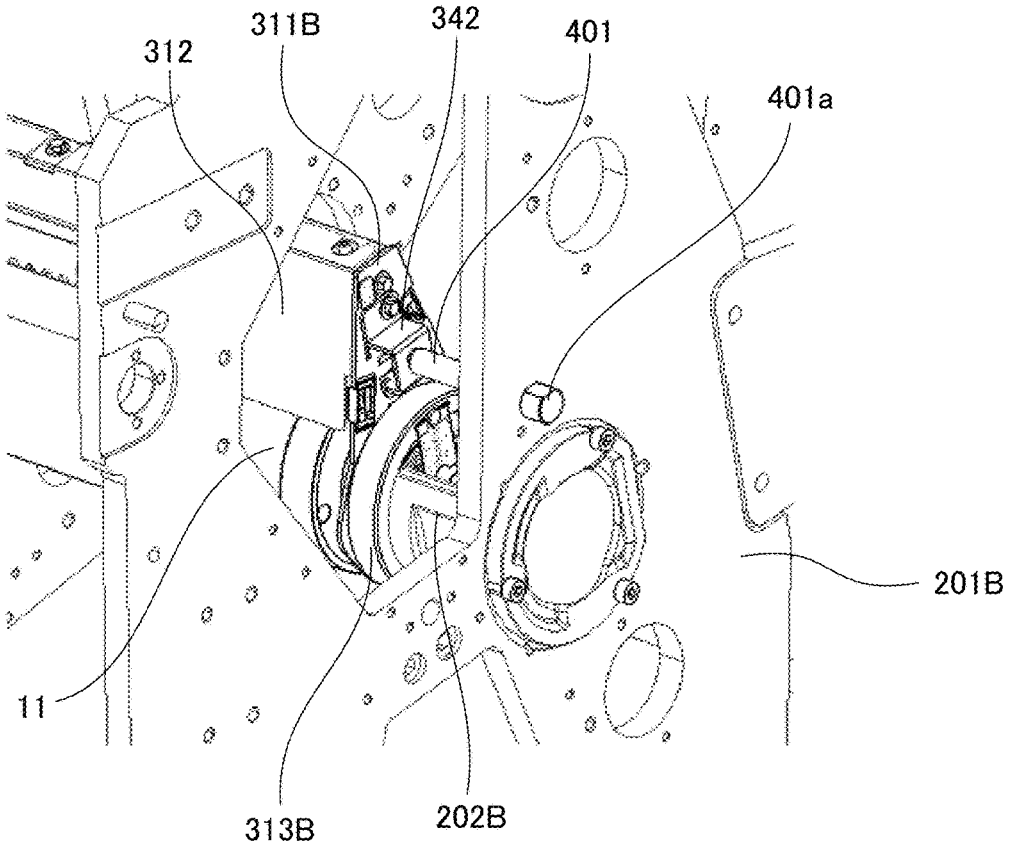
FIG. 19 is a perspective view illustrating a second end portion of the heating roller unit according to one embodiment, in a state held on the side plate.
Figure 21:
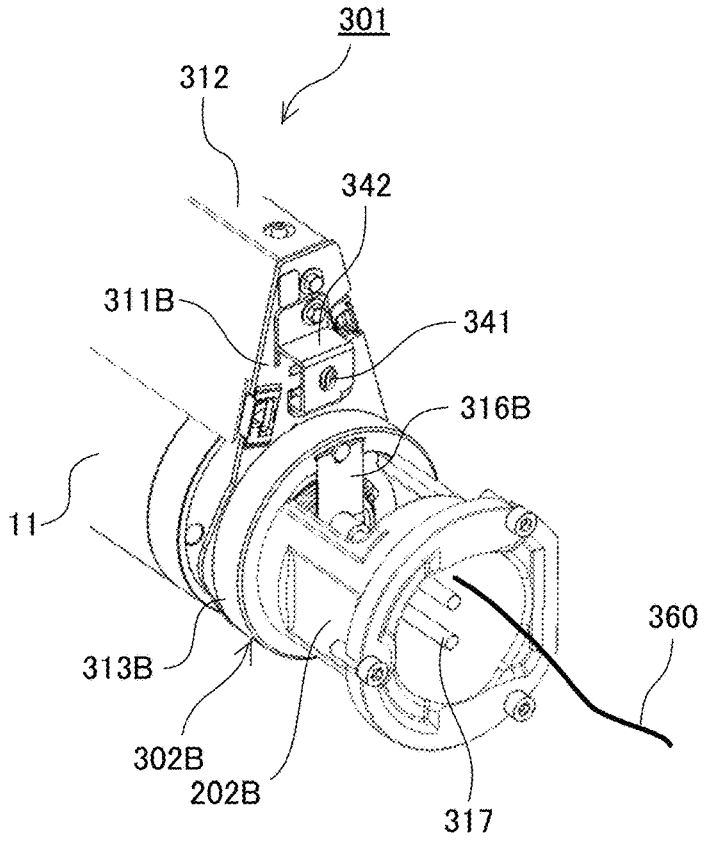
FIG. 21 is a perspective view illustrating a state in which the second end portion of the heating roller unit is fitted in the second tubular holder.
Figure 22:
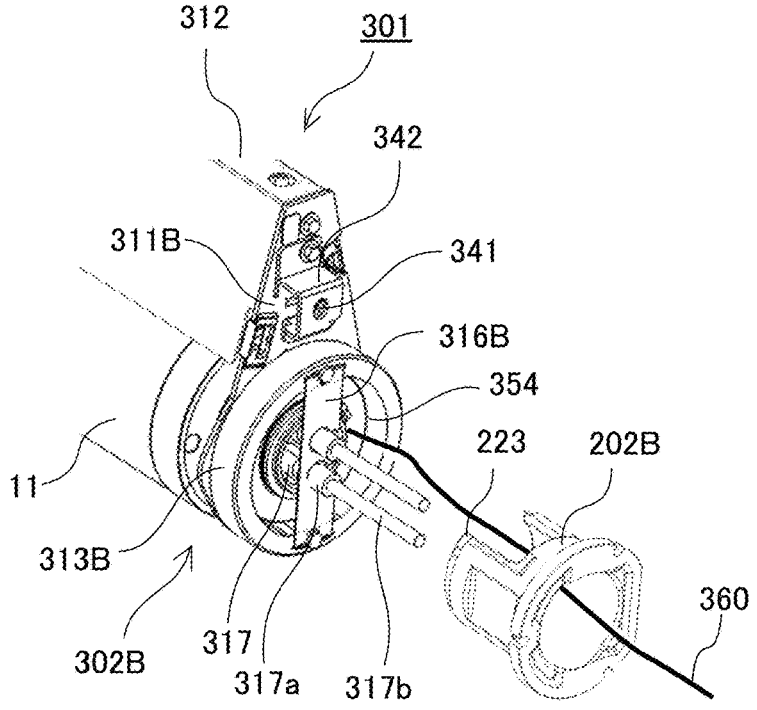
FIG. 22 is an exploded perspective view of the second end portion of the heating roller unit and the second tubular holder.
Figure 23:
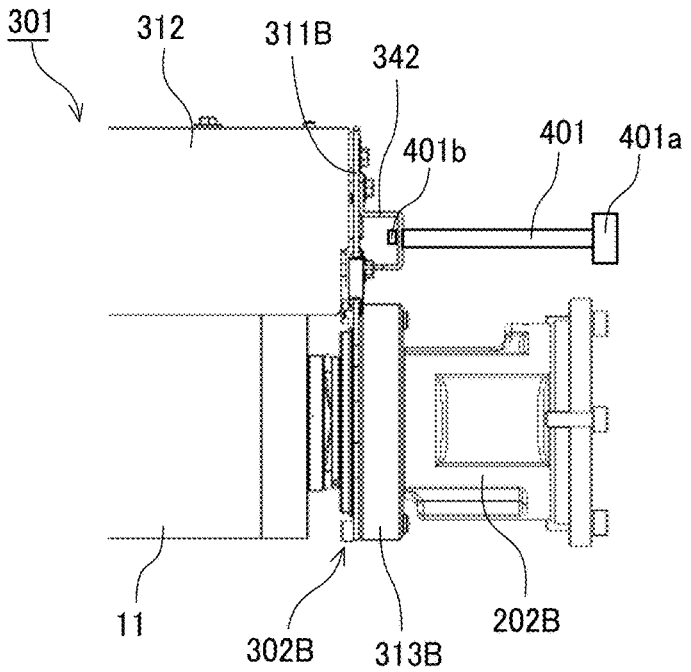
FIG. 23 is a front view illustrating a state in which the second end portion of the heating roller unit is fitted in the second tubular holder.

Next, a structure to hold the second end portion of the heating roller unit on the side plate is described with reference to FIGS. 19 to 23. FIG. 19 is a perspective view illustrating the second end portion of the heating roller unit, in a state held on the side plate. FIG. 20 is a perspective view of the second tubular holder of the side plate. FIG. 21 is a perspective view illustrating a state in which the second end portion of the heating roller unit is fitted in the second tubular holder. FIG. 22 is an exploded perspective view of the second end portion of the heating roller unit and the second tubular holder. FIG. 23 is a front view illustrating a state in which the second end portion of the heating roller unit is fitted in the second tubular holder.

The second tubular holder 202B that holds the second end portion 302B of the heating roller unit 301 is inserted into a mounting opening 251 (see FIG. 20) of the side plate 201B and is attached to the side plate 201B.

Further, the side plate 201B is provided with a pin hole 241 into which a positioning pin 401 is inserted. With the positioning pin 401, the position of the heating roller unit 301 in the rotation direction about the roller axis is determined. The positioning pin 401 includes a head 401*a* that does not pass through the pin hole 241.

As described above with reference to FIG. 9, the heating roller unit 301 includes the heating roller 11, the side plates 311A and 311B provided with the bearings 380 (see FIG. 16) that rotatably hold both ends of the heating roller 11, and the stay 312 to couple the side plates 311A and 311B together.

A circular member 313B, which is a fitting member to fit with the second tubular holder 202B, is fixed to the side plate 311B. On the circular member 313B, a lamp holder 316B is attached. The lamp holder 316B holds the ends of the two heater lamps 317 disposed inside the heating roller 11.

Then, a fitting portion 223 of the second tubular holder 202B is fitted inside an inner peripheral face 354 of the circular member 313B, and the second end portion 302B is held by the second tubular holder 202B. The fitting portion 223 of the second tubular holder 202B include a plurality of projections 224 that contact the inner peripheral face 354 of the circular member 313B.

Further, a socket member 342 in which an insertion hole 341 is formed is fixed to the side plate 311B. A tip 401*b* of the positioning pin 401 can be inserted in and pulled out the insertion hole 341.

Figure 24:
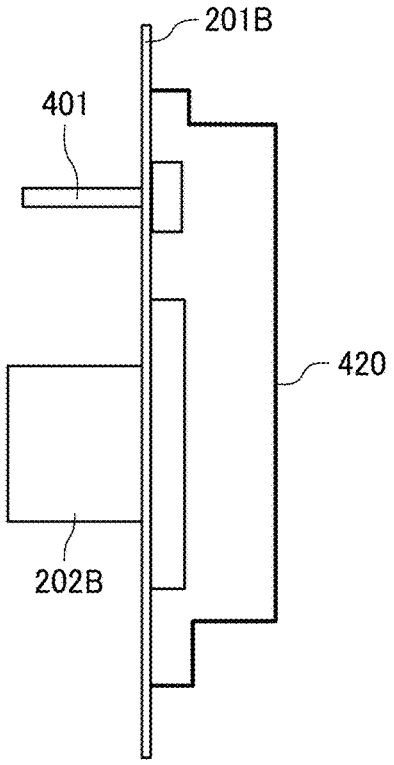
FIG. 24 is a side view illustrating a main part of an end cover attached to the side plate on a second end side.

Next, a description is given below of mounting of the second end portion 302B of the heating roller unit 301 to the side plate 201B, with reference also to FIG. 24. FIG. 24 is a side view of a main part of an end cover attached to the side plate 201B.

First, the first end portion 302A of the heating roller unit 301 is fitted into the first tubular holder 202A of the side plate 201A as described above.

Then, a sensor signal cable 360 coming out of the heating roller unit 301 is drawn out to the front side from a mounting opening 350 on the side plate 201B.

Thereafter, from the front side of the side plate 201B, the operator inserts the positioning pin 401 into the pin hole 241 of the side plate 201B, and further inserts the tip 401*b* of the positioning pin 401 into the insertion hole 341 on the heating roller unit 301.

In this state, the head 401*a* side of the positioning pin 401 inserted into the heating roller unit 301 is engaged with the side plate 201B. Accordingly, even if the operator releases his hand from the heating roller unit 301, the heating roller unit 301 is supported or held by both the side plates 201A and 201B.

Next, the operator inserts the wiring, such as a heater lamp power supply line or the sensor signal cable 360, extending from the heating roller unit 301 from the mounting opening 251 to the side plate 201B, through the second tubular holder 202B.

Then, the second tubular holder 202B is inserted into the mounting opening 251 of the side plate 201B with the cable 360 passed therethrough as illustrated in FIG. 22. Then, the fitting portion 223 is fitted into the circular member 313B of the second end portion 302B of the heating roller unit 301.

The operator can easily perform such mounting work since both hands are free.

Thereafter, the second tubular holder 202B is secured (e.g., screwed) to the side plate 201B. Then, as illustrated in FIG. 24, an end cover member 420 to cover the second tubular holder 202B and the head 401*a* of the positioning pin 401 is attached to the side plate 201B.

As described above, in attaching the second end portion 302B of the heating roller unit 301 to the side plate 201B, the second end portion 302B is supported with the positioning pin 401 on the side plate 201B. Thus, the heating roller unit 301 is held by the side plates 201A and 201B. Accordingly, the operator can perform the subsequent assembling work with both hands free, and the workability of the assembling work is improved.

With the above-described holding structures for the first end and the second end of the heating roller unit 301, the workability of the mounting of the heating roller unit 301 between the side plates 201A and 201B is improved. Similarly, the workability of replacement of the heating roller unit 301 is improved.

Figure 25:
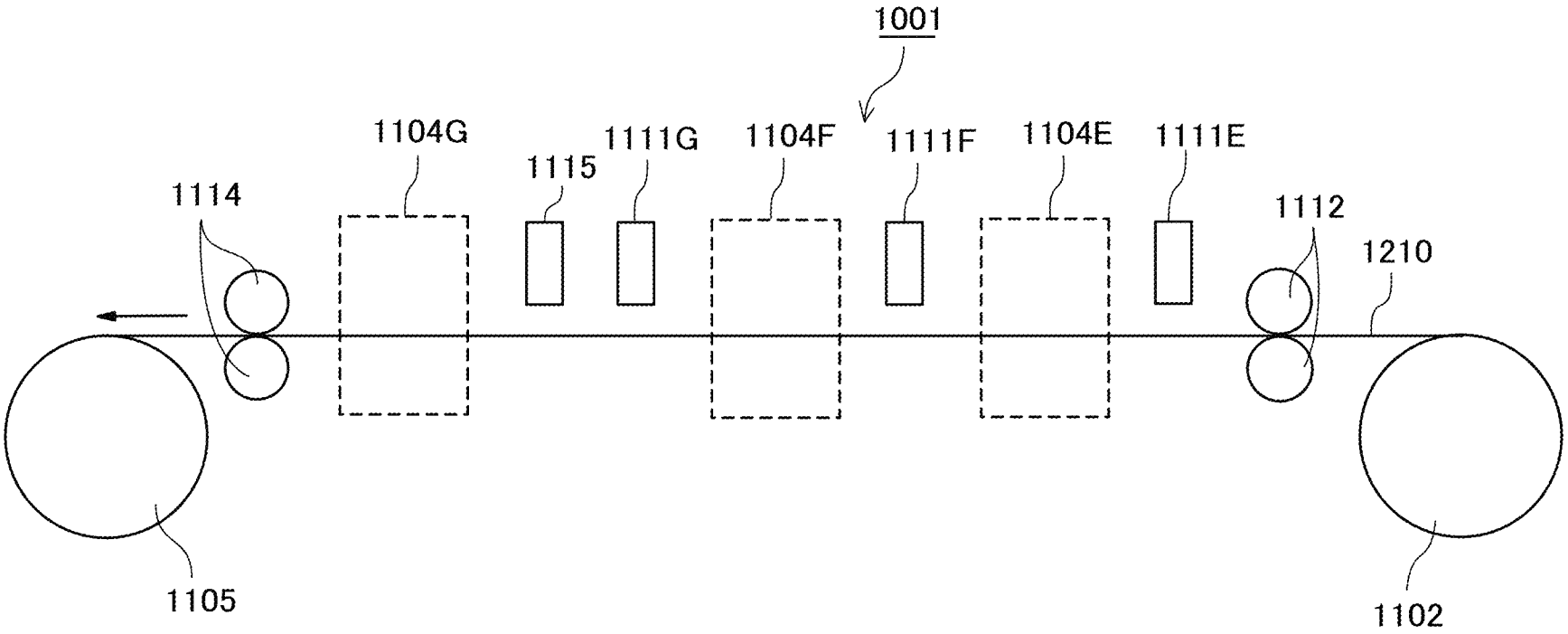
FIG. 25 is a schematic diagram of an example of an electrode printing apparatus as the layer forming apparatus including the drying device according to one embodiment.

Next, a description is given of an example of a layer forming apparatus including a drying device according to the present disclosure with reference to FIG. 25. FIG. 25 is a schematic diagram of an example of an electrode printing apparatus as the layer forming apparatus.

The term "drying" generally signifies removing moisture from a target, but the term "drying" in the present embodiment also signifies vaporizing a liquid as well as moisture.

An electrode printing apparatus 1001 includes a feeding roller 1102, a conveyance roller 1112, an output roller 1114, and a winding roller 1105. The electrode printing apparatus 1001 feeds an electrode base 1210 from the feeding roller 1102.

Between the conveyance roller 1112 and the output roller 1114, the electrode printing apparatus 1001 includes a first liquid discharge head 1111E, a first drying device 1104E, a second liquid discharge head 1111F, a second drying device 1104F, a third liquid discharge head 1111G, a light source 1115, and a third drying device 1104G. in this order from upstream to downstream in the conveyance direction. The first, second, and third liquid discharge heads 1111E, 1111F, and 1111G are examples of liquid application devices.

The first liquid discharge head 1111E is for forming an active material layer and discharges an ink containing an active material (i.e., an active material containing ink) for forming an active material layer, onto the surface of the electrode base 1210.

The drying device 1104E dries, as a drying target, the electrode base 1210 to which the active material containing ink has been applied by the first liquid discharge head 1111E.

The second liquid discharge head 1111F is for forming an inorganic ink layer and discharges a liquid ink for forming an inorganic layer (i.e., an inorganic ink), onto the electrode base 1210 to form an inorganic ink layer.

The drying device 1104F dries, as a drying target, the electrode base 1210 on which the inorganic ink has been applied onto the active material layer by the second liquid discharge head 1111F.

The third liquid discharge head 1111G is for forming a resin layer and discharges a liquid ink for forming a resin layer (i.e., a resin layer ink), onto the electrode base 1210 to form a resin ink layer.

The light source 1115 has a curing capability to irradiate the ink layer on the electrode base 1210 with light such as ultraviolet rays to cure the ink layer into a resin layer.

The drying device 1104G dries, as a drying target, the electrode base 1210 to which the third liquid discharge head 1111G has applied the resin layer ink on the active material layer and the inorganic layer after the resin layer is irradiated with the light from the light source 1115.

The drying device 1104G also has capabilities to heat and promote curing of the ink layer formed by the resin layer ink applied by the third liquid discharge head 111F.

The drying device 1104E, the drying device 1104F, and the drying device 1104G have configurations similar to that of the drying device 104. However, for use in a layer forming apparatus that forms a plurality of layers, the curvature of the conveyance passage for conveying the electrode base 1210 is preferably as small as possible.

Figure 26A:
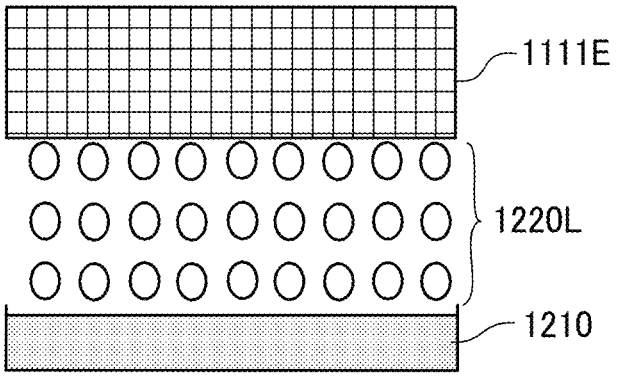
FIGS. 26A to 26C are diagrams illustrating layer forming processes by the electrode printing apparatus illustrated in FIG. 25.
Figure 26B:
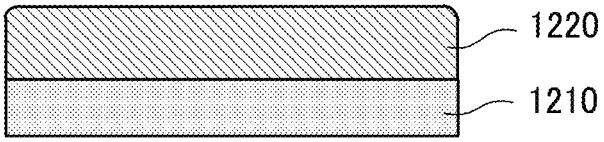
Figure 26C:
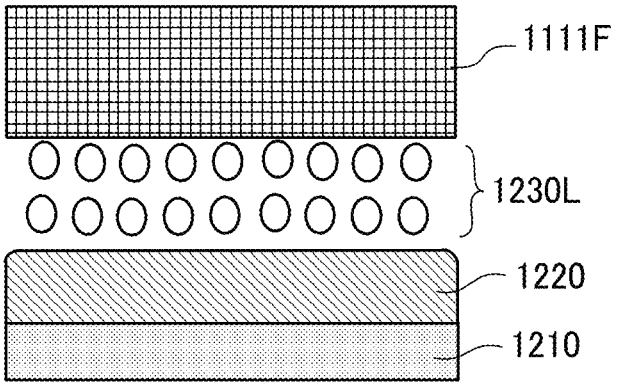
Figure 27A:
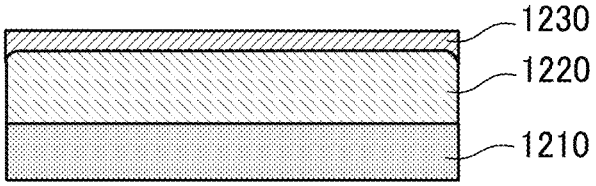
FIGS. 27A to 27C are diagrams illustrating the layer forming processes subsequent to the process illustrated in FIG. 26C.
Figure 27B:
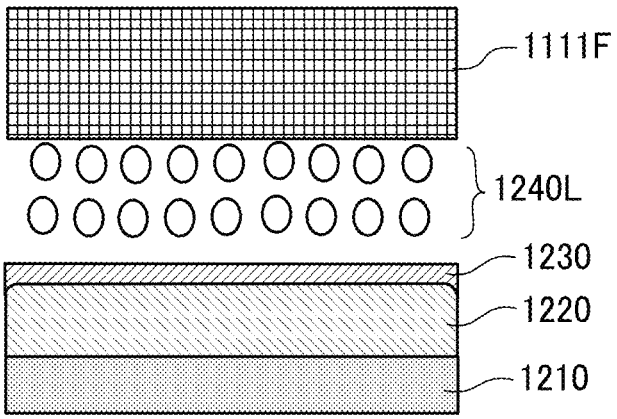
Figure 27C:
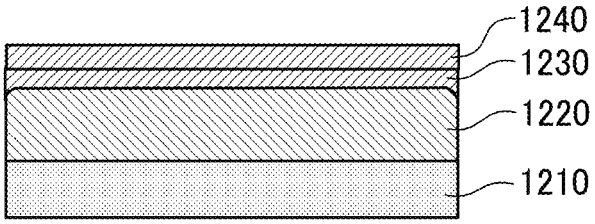

Next, layer forming processes in the electrode printing apparatus 1001 are described with reference to FIGS. 26A to 27C. FIGS. 26A to 26C are diagrams illustrating the layer forming processes. FIGS. 27A to 27C are diagrams illustrating the layer forming processes subsequent to the process illustrated in FIG. 26C.

As illustrated in FIG. 26A, the first liquid discharge head 1111E discharges active material containing ink 1220L onto the surface of the electrode base 1210.

The drying device 1104E dries, as the drying target, the electrode base 1210 provided with the active material layer 1220 formed with the active material containing ink 1220L as illustrated in FIG. 26B.

As illustrated in FIG. 26C, the second liquid discharge head 1111F discharges inorganic ink 1230L onto the surface of the active material layer 1220 on the electrode base 1210.

The drying device 1104E dries, as the drying target, the electrode base 1210 provided with the inorganic layer 1230 formed with the inorganic ink 1230L and the active material layer 1220 as illustrated in FIG. 27A.

As illustrated in FIG. 27B, the third liquid discharge head 1111G discharges resin layer ink 1240L onto the surface of the inorganic layer 1230 on the active material layer 1220 on the electrode base 1210.

The light source 1115 irradiates, with light, the resin layer 1240 formed with the resin layer ink 1240L as illustrated in FIG. 27C, to cure the resin layer 1240.

The drying device 1104G heats the resin layer 1240 formed with the resin layer ink 1240L, to accelerate the curing of the resin layer 1240, as illustrated in FIG. 27C.

In addition, the drying device 1104G dries, as a drying target, the electrode base 1210 provided with the resin layer 1240 formed with the resin layer ink 1240L, the inorganic layer 1230, and the active material layer 1220, as illustrated in FIG. 27C.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A heating roller unit comprising:

a heating roller configured to rotate;

a heat source inside the heating roller; and a tubular member at an end of the heating roller, the tubular member inside which a terminal of the heat source is disposed, the tubular member having an opening via which an inside of the tubular member communicates with an outside in a direction intersecting with an axial direction of the heating roller.

2. The heating roller unit according to claim 1, wherein the heating roller unit is to be mounted in a drying device, and wherein the tubular member includes a fitting portion configured to fit with a tubular holder disposed on a side plate of the drying device, the side plate configured to hold one end of the heating roller unit.

3. The heating roller unit according to claim 2, further comprising a tapered member disposed outward of the fitting portion in the axial direction of the heating roller and configured to enter the tubular holder.

4. The heating roller unit according to claim 1, further comprising a heat source holder made of metal and configured to hold one end of the heat source, wherein the heat source holder is disposed with a portion of the heat source holder protruding from the opening.

5. A drying device comprising the heating roller unit according to claim 1.

6. The drying device according to claim 5, further comprising an air blower disposed along the axial direction of the heating roller, the air blower including:

an air intake configured to introduce air into the air blower; and an air suction fan configured to apply a suction force to the air intake, the air suction fan disposed on a same side as the tubular member of the heating roller unit in the axial direction of the heating roller.

7. The drying device according to claim 5, wherein the drying device is configured to dry a sheet applied with a liquid.

8. A printer comprising:

a liquid application device configured to apply a liquid to a sheet; and the drying device according to claim 5, configured to dry the sheet applied with the liquid by the liquid application device.

* * * * *